United States Patent [19]

Keeffe et al.

[11] Patent Number: 4,812,714

[45] Date of Patent: Mar. 14, 1989

[54] ARC DISCHARGE LAMP WITH ELECTRODELESS ULTRAVIOLET RADIATION STARTING SOURCE

[75] Inventors: William M. Keeffe, Rockport; John F. Waymouth, Marblehead; Gregory Zaslavsky, Brookline, all of Mass.

[73] Assignee: GTE Products Corporation, Danvers, Mass.

[21] Appl. No.: 111,396

[22] Filed: Oct. 22, 1987

[51] Int. Cl.[4] ..... H01J 7/44

[52] U.S. Cl. ..... 315/60; 315/267; 315/59; 315/150; 315/289

[58] Field of Search ..... 315/60, 59, 150, 289, 315/248, 331; 313/54, 197, 214, 229; 250/372, 373, 504 R

[56] References Cited

U.S. PATENT DOCUMENTS

| | | | |
|---|---|---|---|
| 3,226,597 | 12/1965 | Green | 315/60 |
| 3,900,761 | 8/1975 | Freese et al. | 315/60 |
| 4,041,352 | 8/1977 | Mc Neill et al. | 315/248 |
| 4,053,814 | 10/1977 | Regan et al. | 315/248 |
| 4,097,777 | 6/1978 | Bacharowski | 315/60 |
| 4,325,004 | 4/1982 | Proud et al. | 315/45 |
| 4,328,446 | 5/1982 | Fallier et al. | 315/47 |
| 4,355,261 | 10/1982 | Cohen et al. | 315/47 |
| 4,721,888 | 1/1988 | Proud et al. | 315/60 |

*Primary Examiner*—Leo H. Boudreau
*Assistant Examiner*—Michael Razavi
*Attorney, Agent, or Firm*—Carlo S. Bessone

[57] ABSTRACT

A metal halide arc discharge lamp comprises an arc tube containing a chemical fill including mercury and metal halides and having first and second electrodes respectively sealed at opposite ends thereof. An outer envelope surrounds the arc tube and has first and second terminals for electrical connection thereto. An electrodeless source of ultraviolet radiation is provided within the outer envelope proximate the arc tube for producing radiation which illuminates the path between the electrodes of the arc tube to decrease the amount of time for generating a gaseous discharge therebetween. The ultraviolet light source includes an envelope of ultraviolet light transmitting material having opposing ends. Portions of the envelope of the ultraviolet light source are capacitively coupled across the electrodes of the arc tube such that the source produces ultraviolet radiation during lamp starting when the first and second terminals of the lamp are energized.

9 Claims, 2 Drawing Sheets

ARC DISCHARGE LAMP WITH ELECTRODELESS ULTRAVIOLET RADIATION STARTING SOURCE

CROSS-REFERENCE TO A RELATED APPLICATION

This application discloses, but does not claim, inventions which are claimed in U.S. Ser. No. 111 395 filed concurrently herewith, and assigned to the Assignee of this application.

TECHNICAL FIELD

This invention relates to the starting of high pressure metal vapor arc discharge lamps and is especially useful with such lamps having a metallic halide fill.

BACKGROUND OF THE INVENTION

High-pressure metal halide arc discharge lamps generally comprise an elongated arc tube containing an ionizable fill and having press seals at each end of the tube. Disposed within the arc tube are two main electrodes, one at each end. The electrodes are generally supported in the press seals and are usually connected to a thin molybdenum ribbon, disposed within the press seal, the purpose of the ribbon being to provide an electrical feedthrough of low thermal expansion, owing to its thinness, while having sufficient current carrying capacity, owing to its width.

In order to facilitate starting of the gaseous discharge, a starter electrode may be disposed in the arc tube, adjacent to one of the main electrodes. Such an electrode is used because a discharge can be ignited between the starter electrode and its adjacent electrode at a much lower starting voltage than is required to ignite a discharge between the two main electrodes. Once the discharge is ignited, the ionized gas provides primary electrons between the two main electrodes and if enough potential is available between the main electrodes a discharge will be formed therebetween. The starter electrode normally has a resistor in series with it to limit the current flowing through the starter electrode after the discharge has started.

However, the press sealed electrical feedthrough for the starting electrode suffers a sodium electrolysis failure mechanism which leads to premature seal failure and this is made worse at the elevated seal temperatures associated with the newer low color temperature, high efficiency metal halide lamps. For these reasons, the starter electrode approach has been abandoned in favor of a high voltage starting pulse applied directly to the main electrodes of the arc tube. With this method the seal failure problems associated with the starting electrode have been overcome, however, there is a substantial statistical starting time between the time the high voltage is applied to the lamp electrodes and the gas breakdown time when the discharge occurs. By "statistical" starting time, it is meant that the breakdown or starting time for a give lamp and starting circuit is distributed over a range of values, such that, if the voltage is applied N times, the time at which breakdown occurs is distributed over a relatively wide range indicating that in some specific cases, the starting time is relatively short and in some cases, relatively long.

BRIEF SUMMARY OF THE INVENTION

It is, therefore, an object of the present invention to obviate the disadvantages of the prior art.

It is still another object of the invention to provide an improved metal halide arc discharge lamp having a decreased statistical starting time between the time the high voltage is applied to the lamp terminals and the time discharge occurs.

These objects are accomplished in one aspect of the invention by the provision of a metal halide arc discharge lamp comprising an arc tube containing a chemical fill including mercury and metal halides and having first and second electrodes respectively sealed at opposite ends thereof. An outer envelope surrounds the arc tube and has first and second terminals for electrical connection thereto. The lamp further includes means for electrically coupling each of the electrodes of the arc tube to a respective terminal. An electrodeless source of ultraviolet radiation is provided within the outer envelope proximate the arc tube for producing radiation which illuminates the path between the electrodes of the arc tube to decrease the amount of time for generating a gaseous discharge therebetween.

The source of ultraviolet radiation comprises an envelope of ultraviolet light transmitting material having opposing ends and containing a fill material. One of the opposing ends of the envelope of the source of ultraviolet radiation is capacitively coupled to the means for electrically coupling the first electrode of the arc tube to the first terminal. The other of the opposing ends of the envelope of the source of ultraviolet radiation is capacitively coupled to the means for electrically coupling the second electrode of the arc tube to the second terminal such that the source of ultraviolet radiation produces the ultraviolet radiation during lamp starting when the first and second terminals of the lamp are energized.

In accordance with further aspects of the present invention, the envelope of the ultraviolet light source is quartz, Vycor or ultraviolet light transmitting borosilicate glass, having a transmission band extending to a short wave limit of 253.7 nanometers or less.

In accordance with still further teachings of the present invention, the metal halide arc discharge lamp further includes a first contact means coupling the external surface of one of the opposing ends of the envelope of the ultraviolet light source to the means for electrically coupling the first electrode of the arc tube to the first terminal. In a preferred embodiment, the lamp further includes a second contact means coupling the external surface of the other of the opposing ends of the envelope of the ultraviolet light source to the means for electrically coupling the second electrode of the arc tube to the second terminal.

In accordance with further aspects of the present invention, the first and second contact means each comprise a wire helically wrapped around the external surface of a respective opposing end. In an alternative embodiment, the first and second contacts each comprise a mesh sleeve made of a conductive material.

In accordance with still further teachings of the present invention, the envelope of the ultraviolet light source contains a predetermined amount (e.g., 0.9 microcurie) of a radioactive substance such as americium 241.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
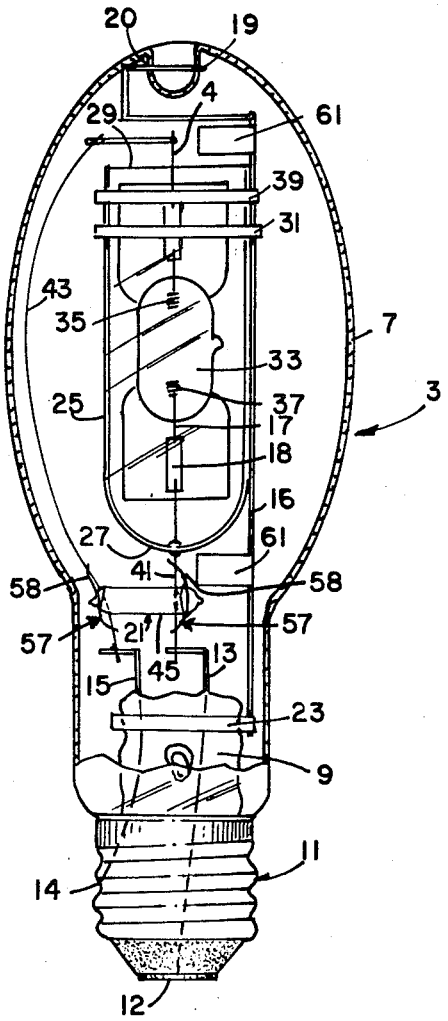
FIG. 1 represents a front elevational view, partially broken away, of an embodiment of a metal halide arc discharge lamp containing an ultraviolet light source according to the present invention.

Referring to the drawings, FIG. 1 illustrates a metal halide arc discharge lamp 3 which includes an evacuated outer envelope 7. Evacuated outer envelope 7 is hermetically sealed to a glass stem member 9. An external base 11, having first and second terminals 12 and 14, respectively, is affixed to the hermetically sealed stem member 9 and evacuated outer envelope 7 for connection to an electrical circuit. The shape of outer envelope 7 and the particular type of external base 11 used for the lamp may differ from that shown in FIG. 1. A pair of stem lead electrical conductors 13 and 15 are sealed into and pass through stem member 9 and are electrically connected to the terminals of base 11 external of evacuated outer envelope 7 to provide access for energization of the discharge lamp 3. Disposed within outer envelope 7 is an arc tube 33 having an ionizable radiation-generating chemical fill including mercury and metal halides which reach pressures of several atmospheres at normal operating temperatures from 600° to 800° C. One suitable fill comprises mercury, sodium iodide, scandium iodide, and an inert gas such as argon to facilitate starting and warm-up. Preferably, the fill includes iodides of sodium and scandium of a ratio in the range of about 20:1 to 28:1. Arc tube 33 also includes first and second electrodes 35 and 37, respectively sealed at opposite ends thereof. A metal outer strap member 39 is affixed to the outer surface of arc tube 33. Strap member 39 is electrically coupled to and mechanically connected to a support member 16.

Support member 16 extends along an axis parallel to the longitudinal axis of the discharge lamp 3 and includes at one end an annular configuration 19 adjacent and in register with an upper portion 20 of evacuated envelope 7. The other end of support member 16 is securely held by strap member 23 which extends around stem member 9, and is electrically isolated from the stem leads 13 and 15.

A heat loss reducing member 25 in the form of a quartz sleeve surrounds arc tube 33. Heat loss reducing member 25 may include a domed portion 27 positioned closest to base 11 and an open-ended portion 29 which is furthest from and faces away from base 11. A metal band 31 surrounds and is affixed to heat loss reducing member 25 and is electrically and mechanically connected to the support member 16.

Electrodes 35, 37 are mounted at opposite ends of arc tube 33, each including a shank portion 17 which extends to a molybdenum foil 18 to which an outer conductor lead 4, 41 is connected. The hermetic seals are made at the molybdenum foils upon which the fused silica of the pinches are pressed during the pitch sealing operation. Arc tube conductor lead 41 is connected to electrical conductor 13. Arc tube lead 4 is connected to a return lead 43, that is disposed adjacent heat loss reducing member 25, which is connected to conductor stem lead 15. Electrical conductors 13, 15 are respectively connected to terminals 12, 14 on a base 11 (e.g., screw base) attached to the neck end of envelope 7 thereby completing the lamp operating circuit.

Getters 61 are positioned within outer envelope 7 and attached to support member 16.

In accordance with the teachings of the instant invention, a metal halide arc discharge lamp 3 further includes an electrodeless source 21 of ultraviolet radiation located within outer envelope 7 and proximate arc tube 33 for producing radiation which illuminates the path between electrodes 35, 37 within arc tube 33 to decrease the amount of time for generating a gaseous discharge therebetween. The addition of a source of ultraviolet radiation adjacent the arc tube, which is activated concurrent with the application of high voltage across the electrodes, substantially lowers the statistical starting time and increases the probability of generating a gaseous discharge between the electrodes of the arc tube. The ultraviolet radiation produces photoelectrons in the discharge gap which enhances gas breakdown and hence the initiation of the discharge between the electrodes of the arc tube.

Figure 2:
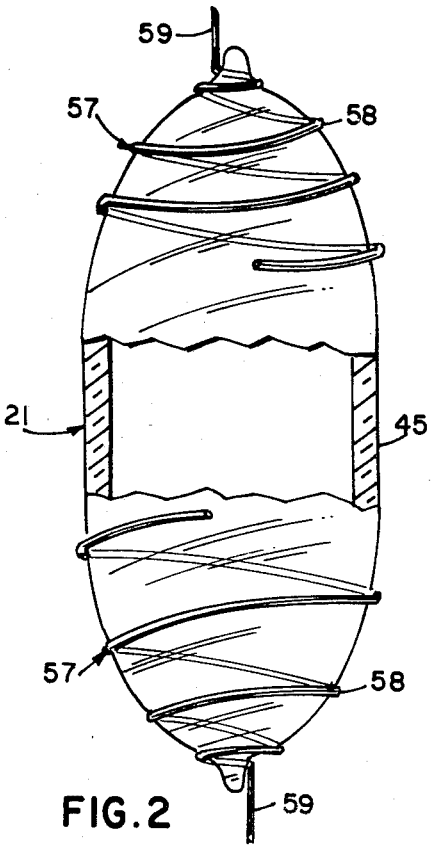
FIG. 2 is a front elevational view, partially broken away, of one embodiment of an ultraviolet light source.
Figure 3:
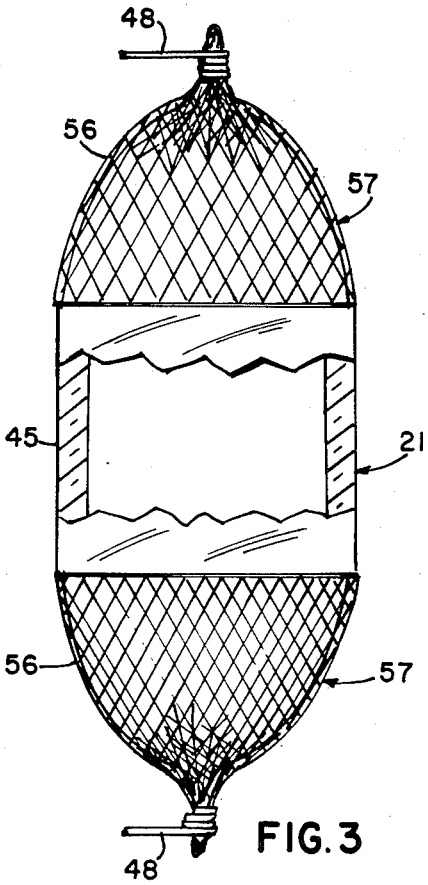
FIG. 3 is a front elevational view, partially broken away, of another embodiment of an ultraviolet light source.

With particular attention to the embodiments illustrated in FIGS. 2 and 3, ultraviolet radiation source 21 includes an envelope 45 of ultraviolet light transmitting material such as pure fused silica (quartz), Vycor brand of high-silica glass or ultraviolet light transmitting borosilicate glass having a transmission band extending to a short wave limit of 253.7 nanometers or less, such as 9741 available from Corning Glass Works. Typically, the envelopes in FIGS. 2 and 3 have as an outside diameter of 0.157 inch (4.0 millimeters), an inside diameter of 0.078 inch (2.0 millimeters), and an overall length of from 0.590 to 0.787 inch (15.0 to 20.0 millimeters).

A getter means (not shown) may be contained within envelope 45. A suitable material for the getter means is ST101/ST505 manufactured by SAES Getters S.p.A., Milan, Italy. The material chosen for the getter means can serve both as a gettering device and a mercury dispenser if mercury is to be included in the fill.

A fill material including as inert gas or combinations thereof or in combination with a quantity of mercury is contained within the envelope of the ultraviolet source at a pressure within the range of from about 1 torr to 50 torr. The combinations may consist of so-called "Penning Mixtures". Preferably, the pressure is within the range of from about 5 torr to 15 torr.

The actual fill pressure of the ultraviolet light source is chosen as a compromise between the desired breakdown voltage of the source (which should ensure ignition with any possible output of the source) and the ultraviolet light output of the source. The intensity of the ultraviolet light generated and the breakdown voltage of the source increases as the fill pressure within the source is increased. In some cases, the compromise may be difficult to achieve. It has been discovered that one method of overcoming this problem is to capacitively couple the ends of the ultraviolet light source. A solid or gaseous radioactive substance such a americium 241 (0.9 microcurie) or krypton 85 may also be included in the fill to lower the breakdown voltage. Capacitively coupling the ultraviolet light source eliminates the need for a ballasting resistor in series with the source.

In the embodiment as illustrated in FIG. 1, portions of the opposing ends of envelope 45 of source 21 are capacitively coupled respectively to return lead 43 and outer conductor lead 41 such that ultraviolet source 21 produces ultraviolet radiation during lamp starting when terminals 12 and 14 of lamp 3 are energized. Preferably, the end portions of envelope 45 are in a contiguous relationship with return lead 43 and outer conductor lead 41.

To further increase the coupling surface area to envelope 45, a contact 57 (FIGS. 1–3) is formed at each of the opposing ends of the ultraviolet light source to capacitively couple the ultraviolet light source to the desired current carrying leads (e.g., return lead 43 and outer conductor lead 41) of the lamp.

In the embodiment illustrated in FIGS. 1 and 2, contact 57 is formed from separate wires 58 helically wrapped around portions of the external surface of envelope 45 of ultraviolet light source 21. In FIG. 1, both ends of the two separate wires 58 are welded respectively to return lead 43 and outer conductor lead 41. In FIG. 2, the remote ends 59 of contacts 57 are formed so as to be welded respectively, for example, to return lead 43 and outer conductor lead 41 of lamp 3. Alternatively, the coupling surface area can be increased by helically wrapping a portion of return lead 43 and a portion of outer conductor lead 41 around portions of the external surface of envelope 45 at the opposing ends of the ultraviolet light source. In the embodiment shown in FIG. 3, each of the contacts 57 is formed from a mesh sleeve 56 made of a conductive material (e.g., tungsten) and has an attaching wire 48 secured thereto for coupling to the desired current carrying lead within the lamp.

In a typical but non-limitative example of a metal halide arc discharge lamp containing a source of ultraviolet light in accordance with the teachings of the present invention, the lamp was a BU/BD M100 metal halide arc discharge lamp. The envelope of the electrodeless ultraviolet light source was formed from quartz glass having an outside diameter of 0.236 inch (6.0 millimeters) and an inside diameter of 0.157 inch (4.0 millimeters). The envelope contained a xenon fill at a pressure of approximately 15 torr. Contacts were formed from separate wires on each of the opposing ends of the source as illustrated in FIG. 1.

Figure 4:
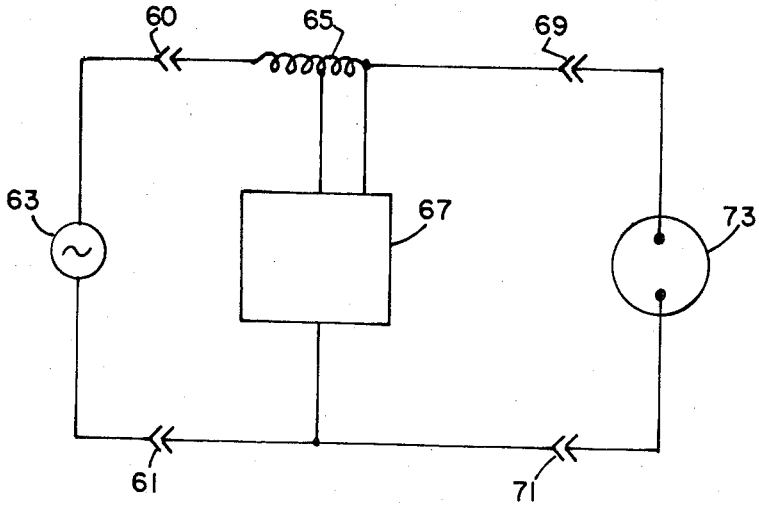
FIG. 4 is a schematic diagram of a metal halide arc discharge lamp assembly.

The dramatic effect of the ultraviolet radiation on the starting time between voltage application and the current flow through the lamp may be more fully appreciated by a comparison of the data of starting times for lamps constructed with and without an ultraviolet light source of the present invention. Test lamps were measured on a known pulse circuit as illustrated in FIG. 4. As shown in FIG. 4, an A.C. voltage source 63 is applied to input terminals 60, 61. An inductive ballast 65, such as model no. 71A5380, is connected between input terminal 60 and one of the terminals 69 of lamp 73. An ignitor 67, such as model no. LI531, is connected across terminals 69, 71 of lamp 73 as shown in FIG. 4. The above-mentioned inductive ballast and ignitor are available from Advance Transformer Company, Chicago, Ill. A suitable ignitor produces a least three high voltage pulses per half cycle having an amplitude of at least 3300 volts and a pulse width of at least 2.0 microseconds.

In a first test, the starting times of lamps constructed similar to that describe in the above example with and without the ultraviolet light source were measured on the pulse circuit of FIG. 4. The lamps measured in the first test were each started twelve times. Results indicated that the metal halide lamp with the ultraviolet light source had an average starting time of approximately 0.01 second compared to an average starting time of 17.3 seconds for a similar lamp without the ultraviolet light source.

In a second test, the starting times of lamps constructed similar to that described in the first test above except the envelope of the ultraviolet light source contained approximately 0.9 microcurie of americium 241. This lamp had an average starting time for twelve starts of approximately 0.013 second.

In a third test, lamps were constructed to determine the effect of mercury within the fill material of the ultraviolet light source. In a first group, the envelope of the ultraviolet light source contained xenon at a pressure of 15 torr. In a second group, the envelope of the source contained 1.0 milligram of mercury and 15 torr argon. The lamps of group two (i.e., mercury and argon) had an average starting time of approximately 80 percent less than group one lamps (i.e., xenon).

The pulse voltage required to start discharge, i.e., breakdown voltage, is reduced by the introduction of the ultraviolet light source described above.

While there have been shown and described what are at present considered to be the preferred embodiments of the invention, it will be apparent to those skilled in the art that various changes and modifications can be made herein without departing from the scope of the invention. The embodiments shown in the drawings and described in the specification are intended to best explain the principles of the invention and its practical application to hereby enable others in the art to best utilize the invention in various embodiments and with various modifications as are suited to the particular use contemplated.

What is claimed is:

1. A metal halide arc discharge lamp comprising:

an arc tube containing a chemical fill including mercury and metal halides and having first and second electrodes respectively sealed at opposite ends thereof;

an outer envelope surrounding said arc tube and having first and second terminals for electrical connection thereto;

means for electrically coupling said first electrode of said arc tube to said first terminal;

means for electrically coupling said second electrode of said arc tube to said second terminal; and an electrodeless source of ultraviolet radiation within said outer envelope proximate said arc tube for producing radiation which illuminates the path between said electrodes of said arc tube to decrease the amount of time for generating a gaseous discharge therebetween, said source of ultraviolet radiation comprising an envelope of ultraviolet light transmitting material having opposing ends, a fill material contained within said envelope of said source of ultraviolet radiation, first contact means capacitively coupling the external surface of one of said opposing ends of said envelope of said source of ultraviolet radiation to said means for electrically coupling said first electrode of said arc tube to said first terminal, second contact means capacitively coupling the external surface of the other of said opposing ends of said envelope of said source of ultraviolet radiation to said means for electrically coupling said second electrode of said arc tube to said second terminal such that said source of ultraviolet radiation produces said ultraviolet radiation during lamp starting when said first and second terminals of said lamp are energized wherein said first and second contact means each comprise a wire helically wrapped around said external surface of a respective opposing end or a mesh sleeve of a conductive material.

2. The metal halide arc discharge lamp of claim 1 wherein said fill material within said envelope of said ultraviolet light source includes a predetermined amount of a radioactive substance.

3. The metal halide arc discharge lamp of claim 2 wherein said radioactive substance within said envelope of said ultraviolet light source is americium 241.

4. The metal halide arc discharge lamp of claim 3 wherein said predetermined amount is approximately 0.9 microcurie.

5. The metal halide arc discharge lamp of claim 1 wherein said envelope of said ultraviolet light source is quartz.

6. The metal halide arc discharge lamp of claim 1 wherein said envelope of said ultraviolet light source is Vycor.

7. The metal halide arc discharge lamp of claim 1 wherein said envelope of said ultraviolet light source is ultraviolet light transmitting borosilicate glass having a transmission band which extends to a short wave limit of 253.7 nanometers or less.

8. The metal halide arc discharge lamp of claim 1 wherein said fill material within said envelope of said ultraviolet light source includes a Penning mixture.

9. A metal halide arc discharge lamp assembly for connection across an A.C. source, said assembly comprising:

a metal halide arc discharge lamp including an arc tube containing a chemical fill including mercury and metal halides and having first and second electrodes respectively sealed at opposite ends thereof, an outer envelope surrounding said arc tube and having first and second terminals for electrical connection thereto, means for electrically coupling said first electrode of said arc tube to said first terminal, means for electrically coupling said second electrode of said arc tube to said second terminal, and an electrodeless source of ultraviolet radiation within said outer envelope proximate said arc tube for producing radiation which illuminates the path between said electrodes of said arc tube to decrease the amount of time for generating a gaseous discharge therebetween, said source of ultraviolet radiation comprising an envelope of ultraviolet light transmitting material having opposing ends, a fill material contained within said envelope of said source of ultraviolet radiation, first contact means capacitively coupling the external surface of one of said opposing ends of said envelope of said source of ultraviolet radiation to said means for electrically coupling said first electrode of said arc tube to said first terminal, second contact means capacitively coupling the external surface of the other of said opposing ends of said envelope of said source of ultraviolet radiation to said means for electrically coupling said second electrode of said arc tube to said second terminal such that said source of ultraviolet radiation produces said ultraviolet radiation during lamp starting when said first and second terminals of said lamp are energized;

input terminals operable to be connected across said A.C. source;

an inductive ballast connected between one of said input terminals and said first terminal of said metal halide arc discharge lamp; and an ignitor means for generating high voltage pulses connected across said metal halide arc discharge lamp.

* * * * *